United States Patent [19]

Erickson

[11] Patent Number: 4,578,095

[45] Date of Patent: Mar. 25, 1986

[54] LOW ENERGY HIGH PURITY OXYGEN PLUS ARGON

[76] Inventor: Donald C. Erickson, 1704 S. Harbor La., Annapolis, Md. 21401

[21] Appl. No.: 642,103

[22] Filed: Aug. 20, 1984

[51] Int. Cl.[4] ..... F25J 3/04

[52] U.S. Cl. ..... 62/22; 62/28; 62/29; 62/31; 62/34; 62/42

[58] Field of Search ..... 62/22, 23, 24, 27, 28, 62/29, 31, 32, 34, 42

[56] References Cited

U.S. PATENT DOCUMENTS 2,699,046 1/1955 Etienne ..... 62/31

3,688,513 9/1972 Streich et al. ..... 62/22

*Primary Examiner*—Frank Sever

[57] ABSTRACT

The invention provides a means of producing high purity oxygen at high recovery plus also byproduct argon while using a low air supply pressure. This is done with a triple pressure distillation arrangement (columns 101, 102, and 103 of FIG. 1) having argon stripping sections at the bottom of both the MP (102) and LP (103) columns, a liquid sidestream withdrawal (117) from the MP column, forming feed for the LP column, an intermediate reflux (118) for the LP column which reboils the MP column, and an argon removal capability.

20 Claims, 3 Drawing Figures

LOW ENERGY HIGH PURITY OXYGEN PLUS ARGON

TECHNICAL FIELD

The invention comprises process and apparatus for improved cryogenic distillation of air to produce high purity oxygen (e.g. 99.5% purity) plus a crude argon byproduct. The improvement results in a substantial reduction in the required compression energy accompanied by an increase in argon recovery, at the expense of a relatively minor increase in capital equipment, thereby improving the overall economics of oxygen production.

BACKGROUND ART

In conventional dual pressure air separation processes high oxygen purity is obtained by supplying a maximum amount of reboil to the argon stripping section of the low pressure column, and the argon recovery is limited by the amount of reboil and reflux availabnle to the argon rectification section of the low pressure column. This is illustrated e.g. in U.S. Pat. No. 2,934,908. In high efficiency flowsheets these limitations are usually even more severe, since in order to decrease the pressure of the high pressure rectifier, (and hence supply air pressure), some of the available reboil normally bypasses the argon stripper. The product oxygen withdrawal or delivery pressure is also usually decreased due to the low HP rectifier pressure.

U.S. Pat. Nos. 3,277,655, 3,327,489, 4,372,765, 4,410,343, and 4,254,629 all disclose low energy flowsheets involving lower than normal HP rectifier pressures, and all result in limited purity oxygen (below about 98%) due to reduced reboil available in the argon stripping section of the LP column. The first four reflect a dual pressure (two column) arrangement, whereas the latter reflects alternatively a triple pressure arrangement with split air supply pressure or a quadruple pressure column arrangement with single supply pressure.

U.S. Pat. No. 2,699,046 to Etienne reflects numerous triple pressure and one quadruple pressure column arrangements. Several of those arrangements also accomplish lower energy requirement at the expense of lower oxygen purity. One, FIG. 6, does not decrease separation energy but increases the purity of the nitrogen product.

U.S. Pat. No. 3,688,513 partly avoids the oxygen purity limitation of low energy triple pressure column flowsheets by incorporating an argon stripper at the bottom of the medium pressure column in addition to the one at the bottom of the LP column. The argon stripping duty is divided between the two strippers, and thus much of the reboil diverted from the LP column to the MP column is still effective in stripping argon. This configuration also incorporates pumped liquid recycle from the LP column overhead back to the MP column, in order to remove argon from the LP column.

This configuration has the disadvantage of not recovering byproduct argon, which in turn causes several additional disadvantages. Since LP column overhead liquid containing argon is recycled to the MP column, and the argon must eventually leave in the MP column, overhead gas, this causes a buildup of argon concentration levels throughout the MP column. The argon concentration must increase until the overhead nitrogen contains on the order of 1% argon, and hence the overhead liquid contains almost 3% (due to the relative volatility between $N_2$ and Ar). The end result is much higher argon concentration in the oxygen rich liquid near the bottom of the MP column, requiring more trays and more reboil in the argon stripping sections of both the LP and MP columns. This equates to greater column pressure drops and hence higher required air supply pressure and higher compression energy (compared to a flowsheet in which the recycle and resulting buildup of argon is not required).

Once the adverse consequences of recycling argon so as to remove it with the nitrogen are discovered, the question occurs as to why the prior art disclosure so definitively emphasizes that recycle, and makes no mention whatever of e.g. argon withdrawl. Although the reason for this is not known with certainty, the discoveries reported in the following disclosure make apparent a likely reason.

In order to achieve high purity it is mandatory to minimize the amount of reboil that bypasses both stripping sections. Of course, the vapor to the refrigeration expander necessarily bypasses the strippers, so little margin is left for other bypass vapor. For crude argon to be withdrawn as product from the LP column overhead, it is very desirable that it be at least about 50% purity, and preferably better than 80% purity. Otherwise, so much product oxygen is lost with the crude argon that the recovery suffers, thereby negating the energy advantage. In order to achieve high enough purity in the overhead vapor of the low pressure column that crude argon can be withdrawn in preference to recycling, a relatively low LP column reflux temperature is required (corresponding to the higer argon content).

However, that reflux temperature gives rise to a correspondingly cold temperature for the vapor that is boiled thereby to become intermediate reboil for the MP column. Colder reboil means that it must be introduced at a higher intermediate location in the MP column. This requires that there by greater reboil in the MP column below that location either from the bottom reboiler (supplied by partially condensing air) or from an intermediate reboiler (suppled by HP column overhead). It is desirable to minimize both of the latter reboils. If there is greater (too much) reboil at the bottom of the MP column, the partially condensed air condensate will have greater $N_2$ content, which requires a higher pressure for the same reboil temperature, and which also decreases the $LN_2$ available from HP rectifier overhead, thus decreasing liquid reflux to MP overhead, thereby increasing $O_2$ content in the nitrogen waste gas and thereby decreasing $O_2$ product recovery. On the other hand, if there is greater reboil input to the MP intermediate reboiler from the HP rectifier overhead, that is also undesirable, because that reboil bypasses both stripping sections. This makes it harder or impossible to produce the desired oxygen purity—at the very least more stripping stages are required, which raises column pressure drops and hence required supply air pressure.

In summary, given the equipment configuration and process steps disclosed in the prior art disclosure, changes in operating conditions necessary to increase crude argon purity sufficiently to allow efficient withdrawal would be expected to cause completely offsetting and disadvantageous results in oxygen purity and recovery, and on the other hand the inefficient withdrawal of the low purity crude argon would cause a similarly disadvantageous decrease in oxygen recovery, and hence there was no preferential alternative to the disclosed crude argon recycle.

What is needed in order to efficiently produce high purity oxygen at high recovery plus crude argon by-product, all at low energy input (low supply air pressure), is an efficient air reboiled triple pressure configuration which allows withdrawal of relatively pure (better than 80%) crude argon without the offsetting disadvantages described above. This is one major objective of the improvement disclosed below.

It is known that in distillation it is desirable to add heat (reboil) to the stripping (bottom) section of a distillation column over a range of tray heights or temperatures, and similarly for the rectifying (top) section to reject heat (i.e., add reflux) over a range of tray heights or temperatures. Several of the prior art idsclosures referred to above incorporate two or more discrete exchanges of heat from the HP rectifier to the stripping section of a lower pressure column. However, it is also known to conduct this heat exchange continuously over a range of tray heights. This is accomplished by "differential" or "non-adiabatic" distillation, as described in U.S. Pat. Nos. 3,508,412 and 3,563,047, 3,756,035, among others.

"Latent heat exchange" refers to an indirect heat exchange process wherein a gas condenses on one side of the heat exchanger and a liquid evaporates on the other, e.g. as occurs in the conventional reboiler/reflux condenser. Normally part of the heat exchange will also unavoidably be due to some sensible heat change of the fluids undergoing heat exchange—thus the label merely signifies the major mechanism of heat exchange, and is not intended to exclude presence of others.

"Air reboiling" is a latent heat exchange between partially condensing air and boiling distillation column bottom product, e.g. the MP column. Reboiling with partially condensing air as opposed to totally condensing air results in a more efficient configuration—the higher $O_2$ content of the condensate allows a lower air pressure to be used to achieve a given reboil temperature.

Additional background art pertinent to this disclosure can be found in U.S. application Ser. No. 501,264 filed 6/6/83 by Donald C. Erickson, which is incorporated by reference.

DISCLOSURE OF INVENTION

The disadvantages of the prior art are overcome by providing a triple pressure air distillation process or apparatus in which: oxygen of at least 98% and preferably about 99.5% purity is produced from air by rectifying pressurized air to liquid nitrogen overhead and kettle liquid in a high pressure (HP) rectifier; the kettle liquid is distilled in a medium pressure (MP) nitrogen rejection column to gaseous nitrogen overhead, product purity oxygen liquid bottom product, and a sidestream withdrawal liquid of oxygen containing primarily argon impurity; the sidestream liquid is distilled in a low pressure oxygen-argon separation column to crude argon overhead fluid and product purity oxygen bottom product; and wherein the improvement comprises:

refluxing an intermediate height of the LP column by exchanging latent heat with a boiling liquid which provides intermediate reboil to the MP column, withdrawing crude argon fluid from the LP column overhead and removing it from the triple pressure distillation apparatus.

The combined application of the two improvements described above is what makes possible the advantageous and unexpected result which overcomes the disadvantages inherent in the prior art teachings. It will be understood by the practitioner of this art that with respect to the essential aspects of the improvement described above or in the claims, there will be many different configurations of flowsheet or particular options within a given arrangement that can utilize the described improvement. These non-essential options are generally known to practitioners of this art, and many are illustrated in the figures or described in the claims. However, it is emphasized that the scope of the claimed invention is limited only by the claims, which are intended to encompass all non-essential variations or options which make use of the disclosed essential inventive entity.

BEST MODE FOR CARRYING OUT THE INVENTION

Figure 1:
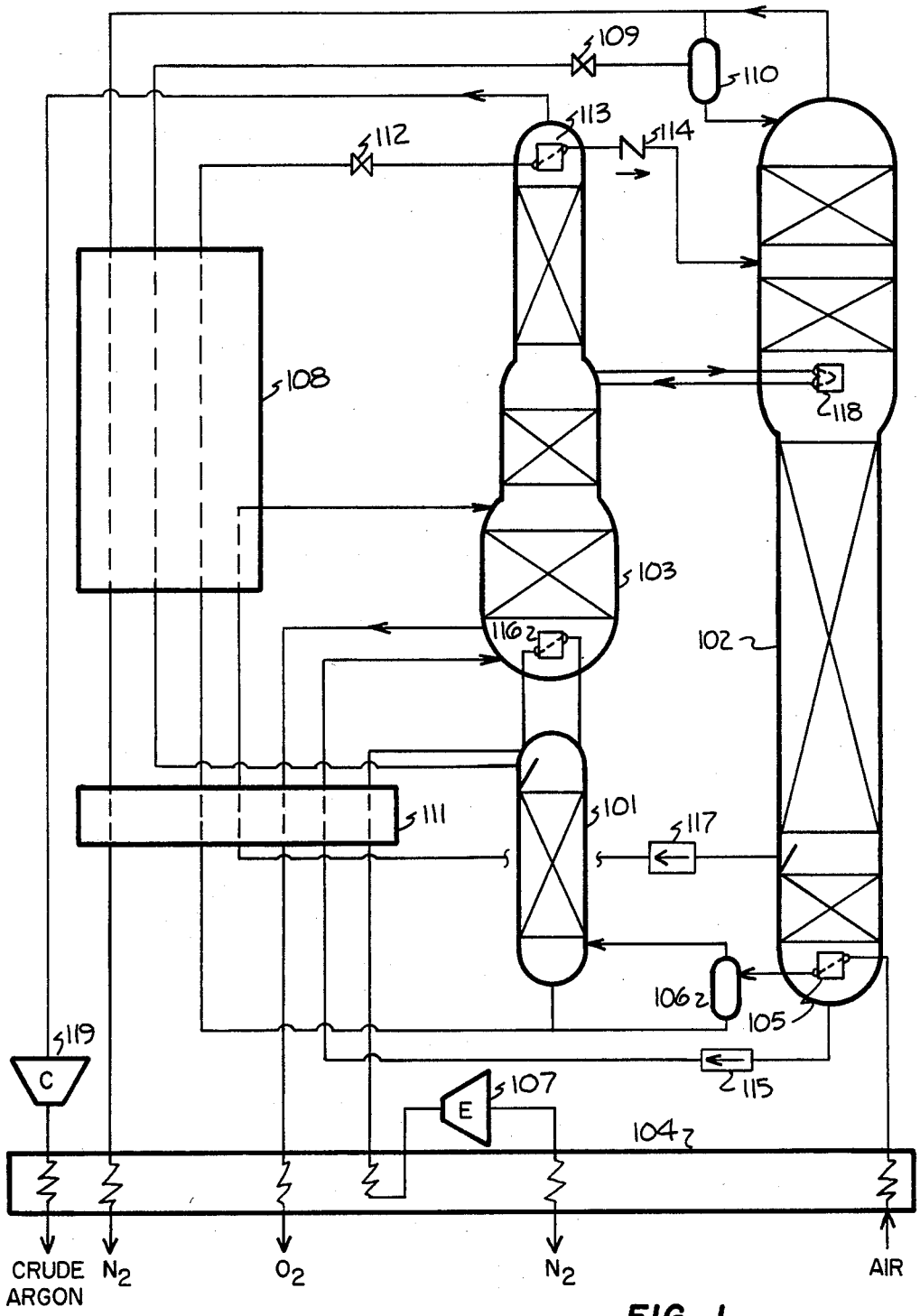
FIG. 1, the preferred or most representative embodiment of flowsheet which embodies the essential aspects of the disclosed invention, is a simplified flowsheet of a triple pressure air distillation arrangement wherein there is a single intermediate reflux of the LP column by latent heat exchange with MP column intermediate height liquid, and wherein the requirement for the latent heat exchange from the HP column overhead to the MP column is avoided, thus maximizing reboil through the two argon strippers.

Referring to FIG. 1, a tripple pressure distillation apparatus incorporating the disclosed invention comprises high pressure rectifier 101, medium pressure nitrogen rejection column 102, and low pressure argon-oxygen separation column 103. Supply air is cooled by main heat exchanger 104 and then routed through partial condenser 105, which is the bottom reboiler for the MP column. The partially condensed air is then routed to HP rectifier 101, which can optionally be via phase separator 106 whereby only the uncondensed portion of the air actually enters the rectifier. The HP rectifier rectifies the supply air to liquid nitrogen overhead and kettle liquid bottom product, plus optionally also gaseous nitrogen overhead for supply to the refrigeration expander 107. Alternatively part of the supply air or the overhead gas from separator 106 could be routed to expander 107, in which case the expander exhaust, still containing on the order of 20% oxygen, would be introduced to the MP column near the top, for further oxygen recovery as is conventional in the prior art.

The liquid nitrogen overhead is subcooled in subcooler 108, let down in pressure (expanded) in valve 109, optionally phase separated in separator 110, and at least the liquid is direct injected into the MP column overhead as reflux therefor.

The kettle liquid is combined with liquid from separator 106, subcooled in subcoolers 111 and 108, expanded by means for pressure reduction 112, and introduced to LP column overhead reflux condenser 113, wherein it is partially evaporated. The partially evaporated kettle liquid is then routed via optional one-way valve 114 into the MP column 102 as feed therefor. Overhead reject nitrogen from column 102 is exhaused via sensible heat exchangers 108, 111, and 014 to atmosphere, although part may be used for byproduct or for sieve regeneration, if desired, in accordance with prior art teachings. Bottom liquid from the MP column cosists of product purity oxygen, which is routed via means for flow control 115 to an evaporator where it is gasified and withdrawn as part of the high purity product oxygen. It will normally be gasified by latent heat exchange with HP rectifier overhead nitrogen, which can be done either with part of the duty of LP column reboiler 116 or with a separate heat exchanger.

MP column sidestream liquid from above the argon stripping section, and containing from 2 to 8% argon and no more than about 0.4% nitrogen is withdrawn and routed via flow control device 117 and subcoolers 111 and 108 to LP column 103 as feed therefor. The product purity bottom product oxygen from column 103 is also gasified and withdrawn, e.g. together with that from column 102 as illustrated.

The essential aspects of the improvement are the intermediate reflux condenser/intermediate reboiler 118, which transfers reboil from above the argon stripping section of the LP column to the MP column below the feed introduction point, and the means for withdrawal of crude argon fluid 119, in this case a vacuum compressor.

Relative to the prevailing atmospheric pressure, the HP rectifier pressure would normally be about 4 to 4.6 atmospheres, the MP column about 1.2 to 1.6, and the LP column about 0.6 to 1.1. In particular, the LP column overhead will normally be below atmospheric pressure, hence the requirement for the vacuum compressor to exhaust the crude argon from the apparatus. The vacuum compressor may be either inside or outside the cold box (defined by heat exchanger 104). Depending on the discharge temperature from compressor 119, the pressurized argon may not be heat exchanged at all. If higher pressures are desired, the crude argon can alternatively be withdrawn as liquid, pumped to the desired pressure, and then evaporated in the heat exchanger. The crude argon purity will normally be in the 80 to 97% purity range, and at least 50%, and hence would require further purification in known apparatus for commercial use. However, it should be noted that the disclosed withdrawal of crude argon is beneficial to the remainder of the process even when it is vented to the atmosphere.

Reboiler/reflux condenser 118 is illustrated as being located within column 102, its preferred location, such that the reboil it generates is inherently introduced into that column. It will be understood however that the reboiler/reflux condenser could alternatively be located in the LP column, or external to both columns, according to the prior art practice with this type of heat exchanger. An important consideration regarding reboiler 118 is that the reboil it generates be introduced into MP column 102 at a height below the feed introduction height, i.e. the height where the partially evaporated kettle liquid from LP column reflux condenser 113 is introduced. By introducing the reboil from the reboiler 118 as low as possible into column 102, the reboil required below that height is minimized, which as explained earlier allows more efficient operation, i.e. improved oxygen product purity and recovery at lower air supply pressures. In general, if the reboil from the LP column intermediate reflux condenser is introduced into the MP column at least two trays below where the reboil from the LP column overhead reflux condenser is introduced, then the MP column liquid composition at that height will be at least 10% higher than at the higher location, and the advantages described above will be fully realized.

EXAMPLE

In order to illustrate the above relationships, a computer simulation was run on the FIG. 1 embodiment using 100 moles of compressed air (mca) as the basis. The compressed air enters reboiler 105 at −289.1° F. and 66.3 psia, forming 22.5 moles of condensate, and the remaining 77.5 moles is routed to column 101 having 23 theoretical trays. Nine moles of better than 99.5% purity $N_2$ are supplied expander 107, and 33 moles of liquid $N_2$ is supplied expansion valve 109. 35.5 moles of kettle liquid are combined with the 22.5 moles of liquid from separator 106 and supplied to reflux condenser 113, wherein it is partially evaporated (about 20 to 25% is evaporated). The theoretical tray count of the MP column is 14 in the argon stripping section, 19 in the nitrogen stripping section, 3 between the two intermediate reboil introduction heights, and 12 in the top nitrogen rectification section. The pressure varies from 22.5 psia at the bottom to 18.9 psia at the top. 68.9 moles of approximately 99% purity nitrogen is withdrawn overhead and combined with 1.2 moles of vapor from separator 110 to form the nitrogen reject stream of 70.1 moles. 7.3 moles of 99.5% purity oxygen liquid is withdrawn from the bottom of the MP column and vaporized. 13.6 moles of sidestream liquid containing 4.6% argon and less than 100 ppm nitrogen is withdrawn from column 102 and conveyed via flow control mechanism 117 to column 103, for argon-oxygen separation. Column 103 theoretical trays are 13 in the argon stripping section, 9 between the feed introduction point and the intermediate reflux, and 34 in the argon rectification section, with bottom and top pressures respectively 16.3 psia and 11.0 psia. 12.94 moles of oxygen product liquid is evaporated and combined with the 7.3 moles from the MP column to yield 20.36 moles of 99.5% purity oxygen, which is a recovery of 96.7%. 0.59 moles of crude argon is withdrawn overhead, at a purity of 94%, representing an argon recovery of 60%. The MP column reboil duty at reboiler 118 increases from 20.4 moles below that reboiler to 44.2 moles above it, at a liquid composition of 69% $O_2$. Three trays higher, where the partially evaporated kettle liquid enters the MP column, the reboil increases from 46.5 moles to 65.3 moles, and the liquid composition is 44% $O_2$, i.e. 25% lower in oxygen than three trays lower. Thus it can be seen that an extremely low reboil rate has been achieved throughout the lower part of the MP column below the intermediate reboiler, and that all reboil exiting the top of the MP column has at some earlier point traversed one or the other of the two argon strippers as reboil.

Figure 2:
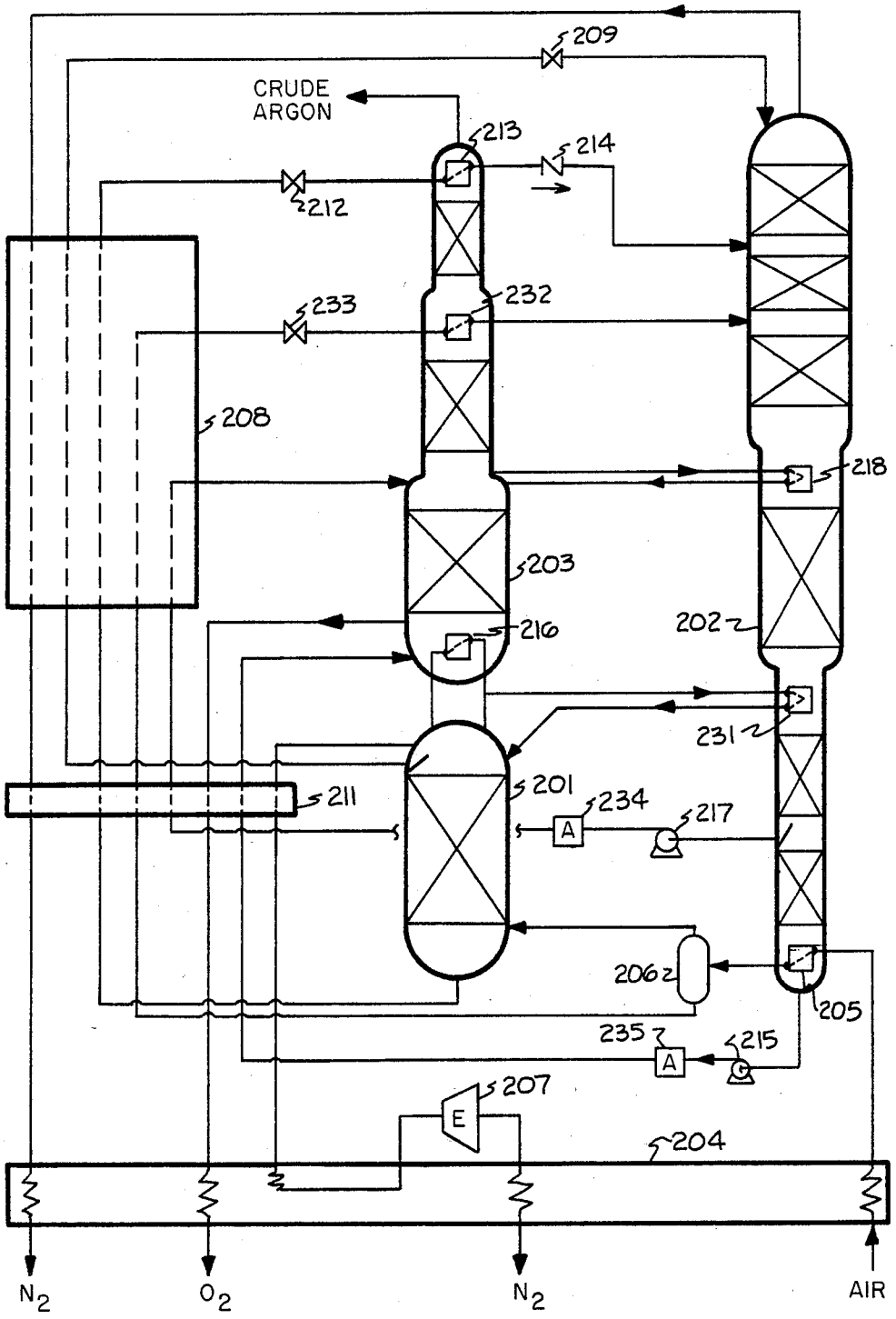
FIG. 2 is a simplified flowsheet of an embodiment having two intermediate refluxes of the LP column, the upper one by kettle liquid and the lower one by LP to MP latent heat exchange, plus also an HP or MP latent heat exchange.
Figure 3:
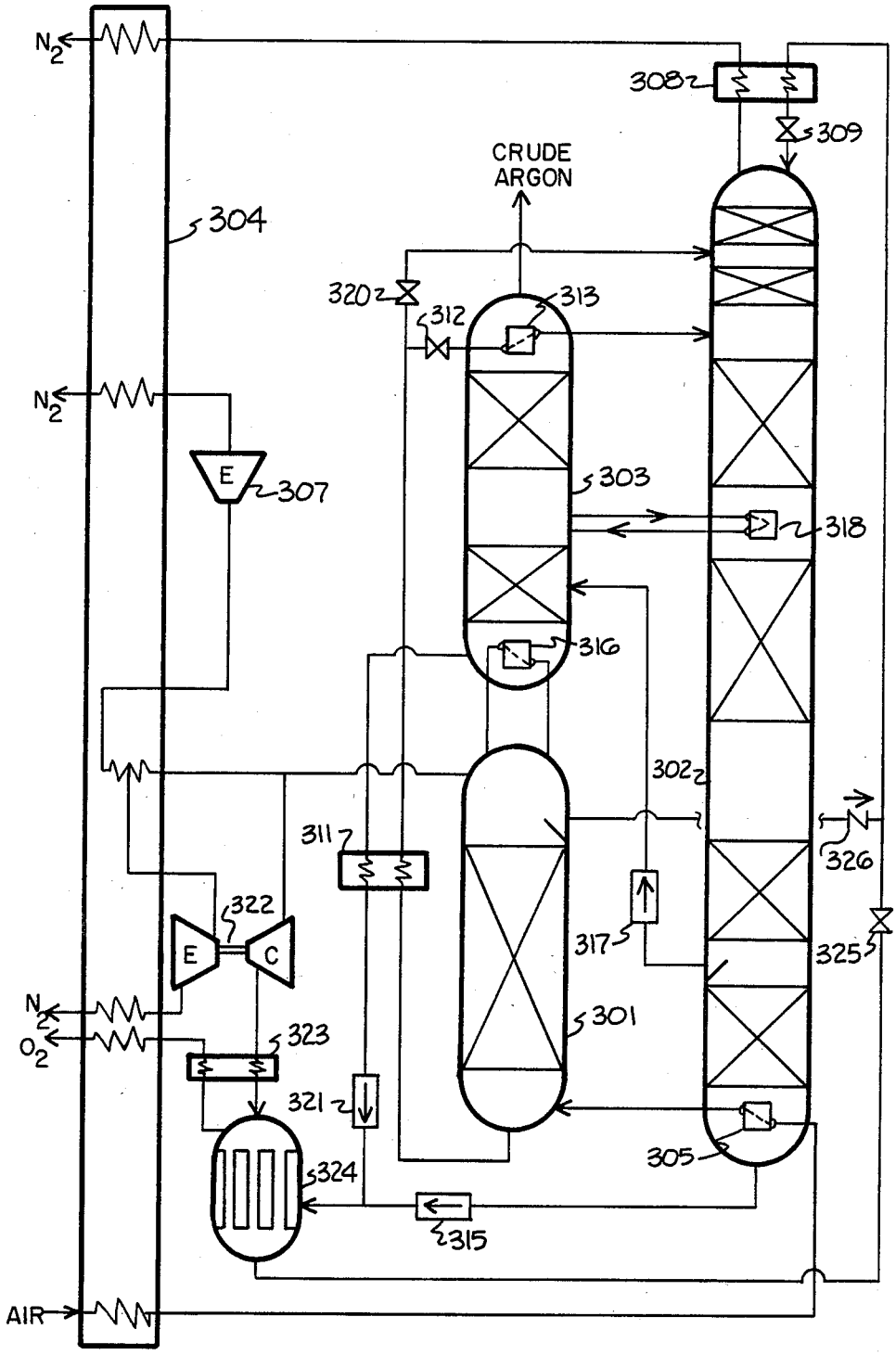
FIG. 3 is a simplified flowsheet of an embodiment similar to FIG. 1 but wherein excess refrigeration nitrogen is available which can be used in a compander to increase the oxygen delivery pressure.

It will be apparent that many options are possible within the scope of and without departing from the spirit of the disclosed improvement. As mentioned earlier, air refrigeration (expander supply) rather than nitrogen refrigeration can be used. Various configurations of air cleanup and sensible heat exchange can be used, e.g. reversing exchangers, pebble bed regenerators, mole sieve cleanup with fixed exchangers, etc. The columns may have sieve trays, bubble caps, packing, or any other configuration of countercurrent vapor liquid contact. The reboiler and reflux condensers may be located internal or external to the columns, and the columns may be vertically segmented. The kettle liquid may be combined with condensate from air reboiler 105, or the two streams may be kept separate. The MP column can be reboiled by vapor from the HP rectifier, either overhead or intermediate vapor, at either an intermediate height or at the bottom in lieu of air reboiling. The LP column feed introduction point does not have to be below the LP intermediate refluxer; it can be at or even slightly above that height. The LP column overhead reflux condenser does not necessarily have to be cooled by partial evaporation of kettle liquid—it could be cooled by another LP to MP latent heat exchanger similar to 118, or even by evaporating liquid nitrogen. This list of options is not intended to be comprehensive, but merely suggestive of the claimed scope. FIGS. 2 and 3 illustrate particularly noteworthy variations or options.

In FIG. 2, components 102 through 209 and 211 through 218 correspond to the similarly numbered 100-series components from FIG. 1. The differences from FIG. 1 are that there are two intermediate reboils of the LP column, one via latent heat exchanger 218 as before, and another via latent heat exchange with condensate from reboiler 205 via letdown valve 233 and latent heat exchanger 232. The flow control devices 215 and 217 are illustrated as being pumps, with optional hydrocarbon adsorbers 234 and 235 to prevent buildup of explosive concentrations of hydrocarbons in the LOX vaporizer. Also illustrated is latent heat exchanger 231 which refluxes column 201 overhead and provides intermediate reboil to column 202. In this flowsheet, either reboiler 218 or reboiler 231 could be eliminated without serious performance penalty, but not both.

In FIG. 3, components 301 through 305, 307 through 313, and 315 through 318 correspond to similarly numbered components on FIG. 1. A slightly different sensible heat exchange configuration is illustrated, and also a minor variation of introducing part of the kettle liquid to the MP column via letdown valve 320 without partial evaporation, which allows somewhat lower reflux ratios at the top of column 302. However the major variation is provision of a separate product LOX vaporizer 324, in which LOX from both the LP and MP columns (via flow control devices 315 and 321) is vaporized. HP rectifier 301 overhead vapor is used to vaporize the LOX; in this flowsheet excess $N_2$ vapor is available (e.g. due to large scale plant or cold ambient conditions either of which reduces required refrigeration), and that $N_2$ is expanded in compander 322, thereby compressing remaining gaseous nitrogen to above the HP rectifier pressure, and hence increasing $O_2$ delivery pressure. Heat exchanger 323 exchanges sensible heat between product $O_2$ and compressed nitrogen, and valves 325 and 326 control the flow of liquid nitrogen to MP column reflux.

The variations described above can appear in any combination. Oxygen or byproduct nitrogen can be withdrawn from more than one tray height to yield different product purities. Some of the latent heat exchange, particularly that between the LP and MP column, can be continuous over a range of tray heights, i.e. "non-adiabatic" or "differential" distillation. Additional columns may be present which fulfill other functions, e.g. there may be a nitrogen removal section of the LP column (separate rectifier) as disclosed in referenced application Ser. No. 501,264. Similarly, there may be an extra high pressure rectifier for direct production of oxygen at up to about 8 atmospheres pressure, as disclosed in copending U.S. patent application Ser. No. 583,817 filed by Donald C. Erickson on Feb. 27, 1984, which is incorporated by reference.

INDUSTRIAL APPLICABILITY

The disclosed improvement will find applicability in industrial scale oxygen producing plants of from 50 to 3000 tons per day capacity. It has the advantages of not involving either dual air supply pressures or dual product pressure, requiring no more total heat exchange duty that a conventional dual pressure configuration, and requiring lesser column height than usual, in addition to the advantages already enumerated.

I claim:

1. In a distillative apparatus for producing high purity oxygen comprising a triple pressure distillation arrangement comprised of a high pressure (HP) rectifier, a medium pressure (MP) nitrogen rejection column, and a low pressure (LP) oxygen-argon separation column, wherein both the LP and MP columns have oxygen-argon stripping sections, and wherein the LP column feed is from a means for withdrawing MP column liquid sidestream from above the argon stripping section of the MP column, the improvement comprising:

an intermediate reflux condenser in the LP column, which exchanges latent heat with a boiling liquid;

means for introducing said boiling liquid into an intermediate height of the MP column;

a means for withdrawing crude argon fluid from the LP column overhead and removing it from the triple pressure distillation apparatus means for evaporating bottom liquid of said MP and LP columns of $O_2$ product of at least 98% purity.

2. The apparatus according to claim 1 further comprising an air reboiler at the bottom of the MP column.

3. The apparatus according to claim 2 further comprised of a conduit and pressure letdown device for conveying kettle liquid to said LP column reflux condenser.

4. The apparatus according to claim 2 further comprised of a conduit for conveying intermediate height liquid from the MP column to said LP column reflux condenser.

5. The apparatus according to claim 4 configured such that the MP column reboil is derived solely from the air reboiler and the LP column intermediate and overhead reflux condensers.

6. In a triple pressure distillation process for producing oxygen of at least 98% and preferably about 99.5% purity from air comprising rectifying pressurized air to liquid nitrogen overhead and kettle liquid in a high pressure (HP) rectifier; distilling the kettle liquid in a medium pressure (MP) nitrogen rejection column to exhaust gaseous nitrogen overhead, product purity oxygen liquid bottom product, and a sidestream withdrawal liquid of oxygen containing primarily argon impurity; distilling the sidestream liquid in a low pressure oxygen-argon separation column to crude argon overhead and product purity oxygen bottom product, the improvement comprising:

refluxing an intermediate height of the LP column by exchanging latent heat with a boiling liquid which provides intermediate reboil to the MP column withdrawing crude argon fluid from the LP column overhead and removing it from the triple pressure distillation apparatus:

withdrawing oxygen as a product.

7. The process according to claim 6 further comprised of reboiling the MP column by partial condensation of supply air; and evaporating MP column liquid bottom product by latent heat exchange with HP rectifier overhead nitrogen.

8. The process according to claim 7 further comprised of controlling the sidestream flow and composition to between 10 and 16 moles per mole of compressed air, argon content between 2 and 7%, and nitrogen content less than 0.4%; and controlling the crude argon concentration to above 50% and argon and preferably above 80%.

9. The process according to claim 8 further comprising boiling kettle liquid in said LP column intermediate reflux condenser.

10. The process according to claim 8 further comprising boiling MP column intermediate height liquid in said LP column intermediate reflux condenser.

11. The process according to claim 8 further comprising withdrawing crude argon as vapor and compressing it to above atmospheric pressure.

12. The process according to claim 8 further comprising refluxing the LP column overhead by latent heat exchange with at least part of the kettle liquid, and introducing the partially evaporated kettle liquid into the MP column at an intermediate height which is above the height of the intermediate reboil obtained from the LP column intermediate reflux condenser; and providing process refrigeration by work expanding part of the HP rectifier overhead gaseous nitrogen; and maintaining HP rectifier pressure between 4 and 4.6 times atmospheric pressure, MP column 1.1 to 1.7, and LP column 0.6 to 1.2 times atmospheric pressure.

13. A process for obtaining high purity oxygen and crude argon from air comprising (a) compressing, cleaning, and cooling the air to near its dewpoint (b) partially condensing the air in a reboiler of a nitrogen rejection distillation column (MP column);

passing the remaining uncondensed air to a high pressure (HP) rectifier;

(d) rectifying said remaining air to at least a liquid $N_2$ overhead product and an oxygen enriched liquid (kettle liquid) bottom product;

(e) passing said kettle liquid to said MP column as feed therefor by at least one of the steps of (I) feeding it directly to the column after expansion to column pressure;

(II) at least partially evaporating it by latent heat exchange with vaporous reflux fluid from the LP column described in step (f) prior to passing it to said MP column;

(f) withdrawing a sidestream of liquid oxygen containing argon impurity from near the bottom of the MP column and passing it to an argon-oxygen distillation column (LP column) as feed therefor;

(g) distilling said sidestream to high purity oxygen bottom product and crude argon overhead product (h) withdrawing said crude argon;

(i) refluxing said LP column at at least two vertically spaced locations by latent heat exchange with at least two evaporating liquids, which are obtained from at least one of the following sources:

(I) a midlength location of the MP column, (II) the kettle liquid as per step (e) (II);

(j) introducing said at least partially evaporated liquids from step (i) into said MP column at vertically spaced locations;

(k) evaporating the bottom product from said MP and LP columns, and withdrawing the resulting gaseous oxygen of at least 98% purity.

14. The process according to claim 13 wherein the LP column overhead reflux is by evaporation kettle liquid and the LP column intermediate reflux is by latent heat exchange between LP column vapor and MP column intermediate height liquid.

15. The process according to claim 13 further comprising compressing HP rectifier overhead nitrogen and condensing it against said MP and LP column liquid bottom products.

16. The process according to claim 13 further comprising providing essentially all the liquid $N_2$ for refluxing the HP rectifier and MP column by exchanging latent heat between HP rectifier overhead $N_2$ and bottom liquid of the MP and LP columns.

17. The process according to claim 13 further comprising withdrawing crude argon as liquid, pumping it to desired delivery pressure, and then evaporating it.

18. A triple pressure apparatus comprising means designed for distilling air to oxygen of at least 98% purity including:

(a) a high pressure rectifier;

(b) a medium pressure nitrogen rejection column with a bottom argon stripping section and a sidestream liquid withdrawal point above the argon stripping section;

(c) a low pressure argon-oxygen distillation column with an intermediate reflux condenser which supplies intermediate reboil to the MP column;

(d) a conduit for withdrawing crude argon from the LP column overhead and removing it from the triple pressure distillation apparatus.

19. The apparatus according to claim 18 further comprised of an air reboiler for the MP column.

20. The apparatus according to claim 19 further comprised of a vaporizer to boil the LOX bottom product from the LP and MP columns and a compander to supply pressurized HP rectifier nitrogen to the vaporizer.

* * * * *